United States Patent [19]

Miller et al.

[11] 4,374,564

[45] Feb. 22, 1983

[54] TICKET DIVERTER MODULE

[75] Inventors: Gregory E. Miller, Escondido; John E. Toth, San Diego, both of Calif.

[73] Assignee: Cubic Western Data, San Diego, Calif.

[21] Appl. No.: 211,029

[22] Filed: Dec. 1, 1980

[51] Int. Cl.[3] ..... B07C 5/00

[52] U.S. Cl. ..... 209/583; 209/657; 194/4 C

[58] Field of Search ..... 209/534, 583, 584, 657, 209/509; 194/41 C

[56] References Cited

U.S. PATENT DOCUMENTS

| | | | |
|---|---|---|---|
| 3,706,374 | 12/1972 | Ptacek | 209/534 |
| 3,765,523 | 10/1973 | Nakanishi | 209/534 X |
| 3,850,299 | 11/1974 | Kreitzer | 209/534 X |
| 3,997,044 | 12/1976 | Schasser | 194/4 C |
| 4,251,000 | 2/1981 | Templeton | 209/657 X |
| 4,318,484 | 3/1982 | Stiernspetz | 209/534 |

*Primary Examiner*—Allen N. Knowles
*Attorney, Agent, or Firm*—Brown & Martin

[57] ABSTRACT

A ticket diverter module for placement in a ticket handling system includes a housing having a transport passage for receiving a ticket from an adjacent transport module, and a diverter blade for selectively diverting the ticket to either one of an exit passage for return to a patron or a capture passage for discarding. An alternate embodiment includes an escrow control device for retaining the ticket in a holding position within the capture passage for inspection. A further embodiment includes a thermal cancel device for cancelling a ticket.

9 Claims, 8 Drawing Figures

TICKET DIVERTER MODULE

REFERENCE TO RELATED APPLICATIONS

The present application is directed to a modular unit that is part of a system covered by co-pending application Ser. No. 211,022 entitled "Modularized Ticket Handling System For Use In Automatic Ticket Processing System", by John B. Roes et al and filed Dec. 1, 1980.

BACKGROUND OF THE INVENTION

The present invention relates to ticket handling systems and pertains particularly to a ticket diverter module for such systems.

Automated ticket handling systems are becoming more prevalent throughout the world today. Such ticket handling systems are useful in conjunction with transportation systems, entertainment and sporting events, and banking and other similar operations.

The utilization of automated equipment is becoming more popular in order to reduce labor costs involved in ticketing and the like, and to reduce losses due to theft and pilferage. In order to be feasible, such automated ticketing systems must be highly reliable, durable and easily repaired. The approach of the present invention to the problem of reliability and easy repair is the construction of systems in modular units that are quickly and easily removable and replaceable within the system. This approach is to separate the various functions involved in the system into separate and distinct functions performed by separate and distinct modular units. This quickly and easily isolates functional failures into modular units which can be quickly and easily removed and replaced to quickly correct the functional problem.

It is also desirable that such units be as simple and inexpensive as possible.

SUMMARY AND OBJECTS OF THE INVENTION

It is the primary object of the present invention to provide an improved diverter module for a ticket handling system.

In accordance with the primary aspect of the present invention a diverter module for a ticket handling system includes a ticket inlet passage with selective diverter means for selectively diverting a ticket to a selected one of an exit passage or a capture passage in response to predetermined signals.

BRIEF DESCRIPTION OF THE DRAWINGS

The above and other objects and advantages of the present invention will become apparent from the following description when read in conjunction with the drawings wherein.

DETAILED DESCRIPTION OF PREFERRED EMBODIMENTS

Figure 1:
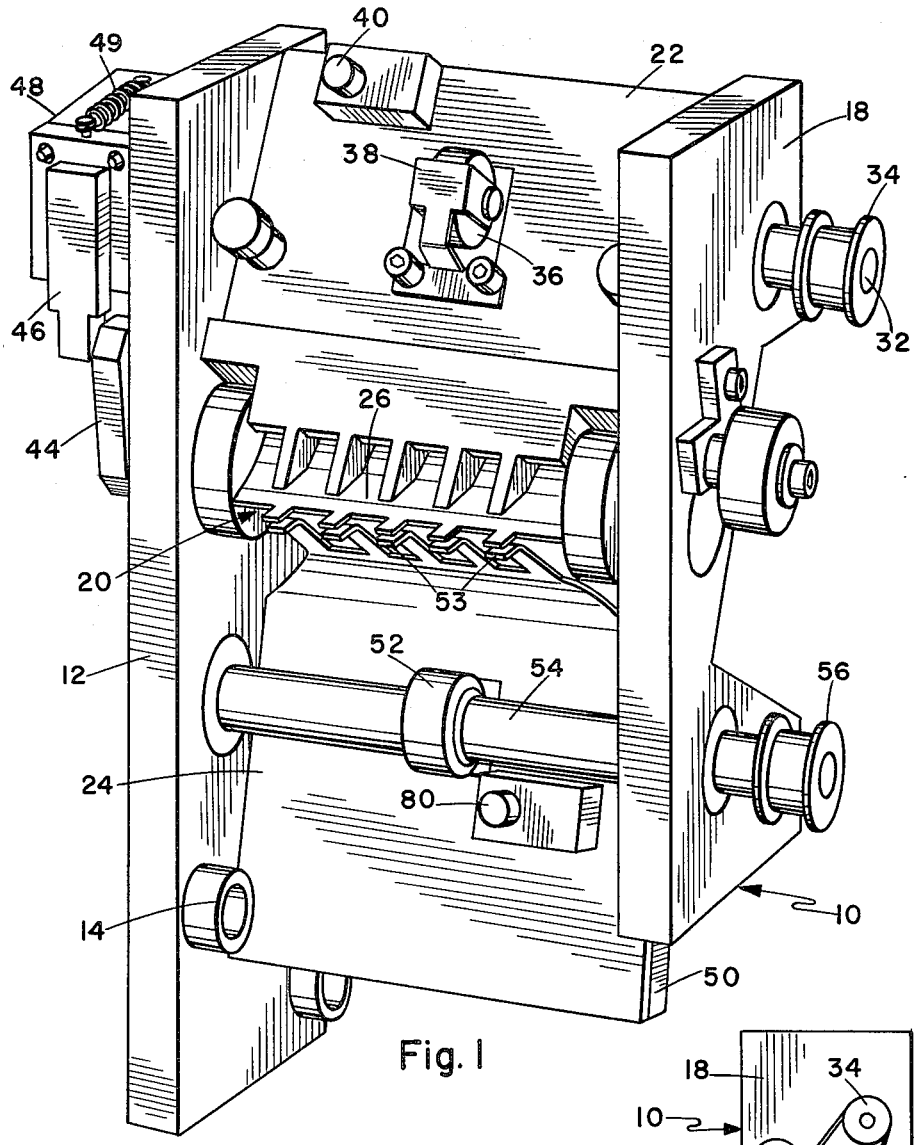
FIG. 1 is a perspective view of the ticket diverter module from the ticket entry side.

Turning to FIG. 1 of the drawing a diverter module 10 is illustrated in a perspective view showing the unit from the ticket entry end and generally comprises a housing having a base mounting plate 12 with a plurality of mounting bores 14 for receiving quick release screws for mounting the unit to a wall panel or mounting plate (not shown). The unit is designed for detachably mounting on a wall panel of mounting plate adjacent to and in mechanical interfacing relation with an adjacent modular system unit such as a transport module 16. The ticket handling system is designed to include related modular units that quickly and easily detachably mount directly to a support panel plate for quick and easy detachable removal of the modular units. Each modular unit is interfaced with but not directly secured to adjacent units. This modularized construction permits the quick and easy removal of any one of the modular units independent of the remaining units and replacement thereof such that a defective unit may be quickly and easily replaced, and taken to a shop or maintenance station for repair and the like.

Figure 2:
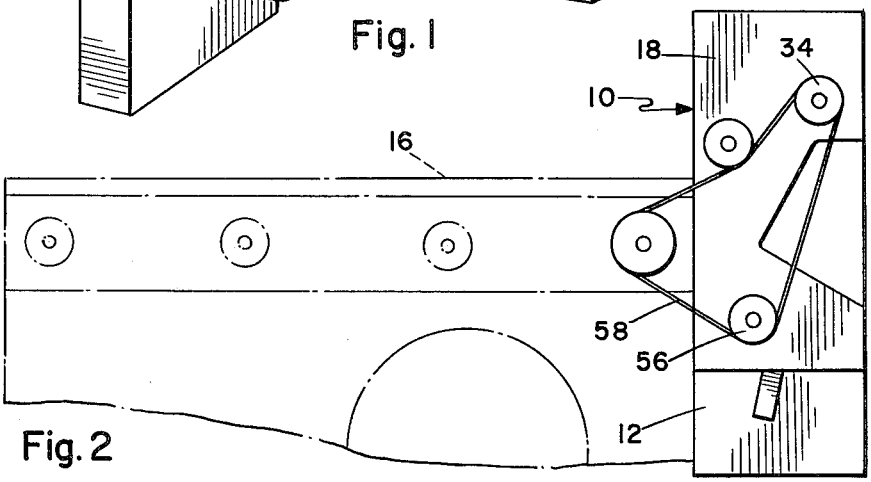
FIG. 2 is a side elevation view of a reduced scale showing the diverter module attached to a ticket transport module.

As best seen in FIG. 2, the unit 10 interfaces with an adjacent transport module 16 for receiving a ticket therefrom. The unit comprises a base plate 12 as above described and a spaced apart end plate 18 having a plurality of plates mounted therebetween for defining a plurality of ticket passages to be described.

As seen in FIG. 1, a ticket inlet opening designated generally by the numeral 20 is defined by spaced apart forwardly extending fingers formed at the forward edge of upper and lower plates 22 and 24. These fingers match with and interface with like fingers at the outlet of the transport passage of the transport module. This enables the unit to mechanically interface with, for receiving a ticket from, the transport module.

A diverter plate 26 is mounted on a shaft in bearings in spaced apart aligned bores in the end plates 12 and 18 and is movable about its axis for approximately 15° of oscillation for selectively directing a ticket to a selected one of two passages. An exit passage extends upward from the inlet 20 to the top of the unit for returning a ticket to a patron from the transport unit. A capture passage extends downward from the inlet 20 of the unit for capturing a ticket and holding it for escrow or for dumping it to a discard bin for used or defective tickets.

Figure 5:
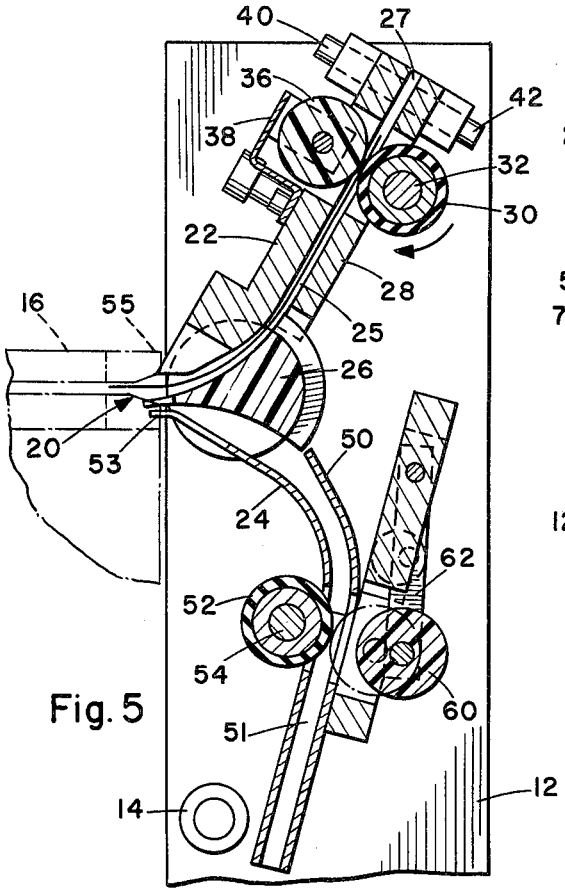
FIG. 5 is a sectional view taken on line 5—5 of FIG. 3.

The exit passage 25 opens upward and angles backward toward the back of the unit at an angle as will be seen in FIG. 5 to an outlet or exit opening 27 at the upper edge of the unit. The unit will be housed within a housing or the like and a ticket will be returned to a patron at this outlet. The exit passage 25 is defined by the upper plate 22 which is detachably secured to a lower plate 28 with the lower plate 28 being mounted between the inner and outer side plates 12 and 18. An exit ticket drive or transport roller 30 is mounted on a rotatably shaft 32 which is rotatably mounted bearings in the side plates 12 and 18 and driven by a pulley 34. The transport roller 30 extends through an opening in the lower plate and into the exit passage 25 defined between the plates 22 and 28 for engaging the ticket therein.

A pinch roller 36 as seen in FIGS. 1 and 5, is mounted on the upper plate 22 by a spring biased bracket 38 and extends through an opening plate 22 for engaging the drive roller and pinching a ticket therebetween.

Ticket sensing means such as a light emitting diode LED 40 and a light sensing unit 42 are mounted on the upper and lower plates and sense the presence or passage of a ticket therebetween. These are connected in a control circuit not shown but shown and described in the aforementioned related application for controlling the transport module.

Figure 3:
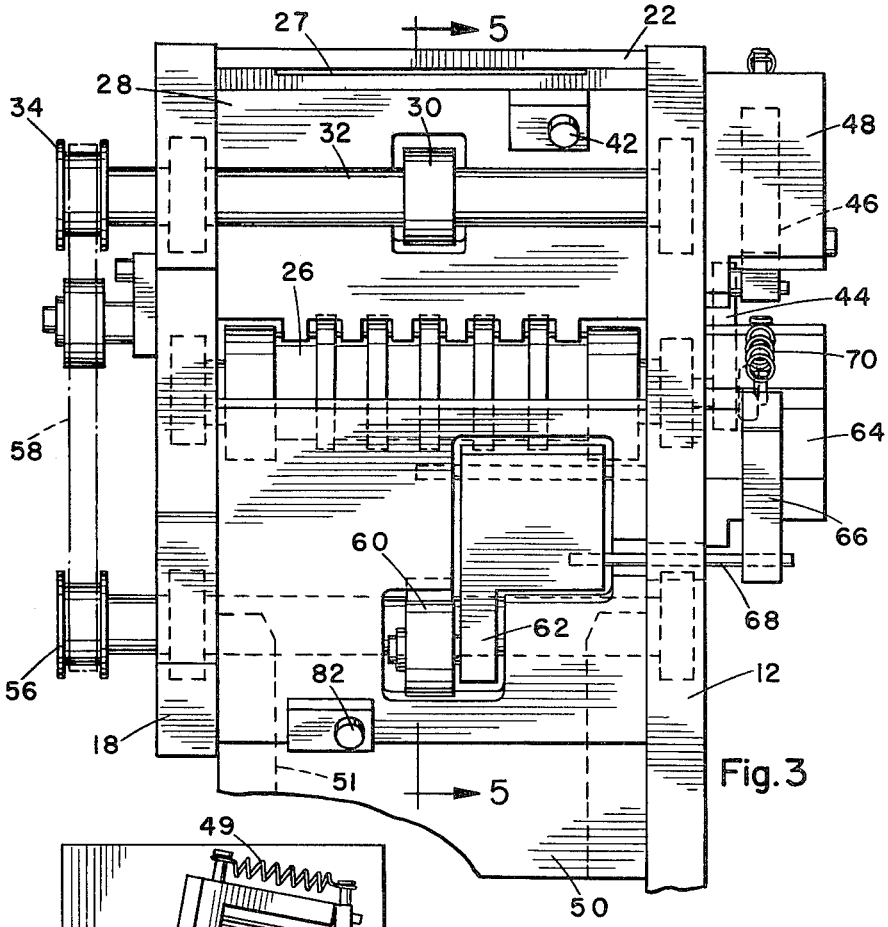
FIG. 3 is a rear elevation view of the module.

The diverter plate 26 for diverting the ticket to the exit passage or the capture passage as seen in FIG. 3 of a generally pie shaped configuration and is formed or mounted on a shaft of the like, journaled in the end plates 12 and 18. The curved back portion of the plate 26 includes arcuate ridges therearound for extending into slots in the plate 28. Attached to the end of the shaft for selectively rotating the plate to its selective diverting positions is an arm 44 (FIG. 4) connected to an arm 46 of a clapper type solenoid 48. A spring 49 biases the arm 46 to a position for normally holding diverter 26 to the lower position (FIG. 5) for diverting a ticket to the exit passage. The solenoid is controlled by a signal from the transport unit for selectively rotating the diverter plate to its upper diverter position (FIG. 6).

Figure 6:
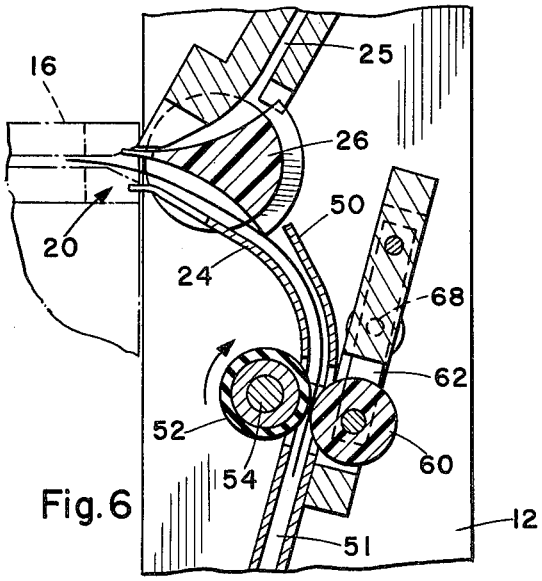
FIG. 6 is a similar section view showing the diverter actuated.
Figure 8:
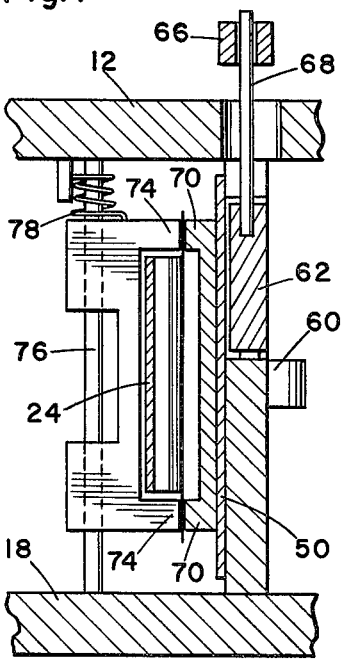
FIG. 8 is a sectional view taken on line 8—8 of FIG. 7.

As best seen in FIGS. 5 and 6, the lower passage or capture passage 51 is defined by plate 24 and a spaced apart plate 50, both of which curve from a position intersecting the diverter plate 26 at the top downward to a position for dumping a ticket into a discard container or the like. The plate 24 of the capture passage includes a plurality of fingers 53 which mesh with and cooperate with like fingers 55 at the end or outlet of the transport passage of the transport module.

As best seen in FIGS. 1 and 5, a transport roller 52 for the capture passage is mounted on a shaft 54 journaled in the end plates 12 and 18 and driven by a pulley 56 from a common drive belt or chain 58 (FIG. 2) driven from the transport unit as shown in FIG. 2. This transport roller 52 extends through an opening in the lower plate 24 into the capture passage for engaging and driving a ticket therein.

Figure 4:
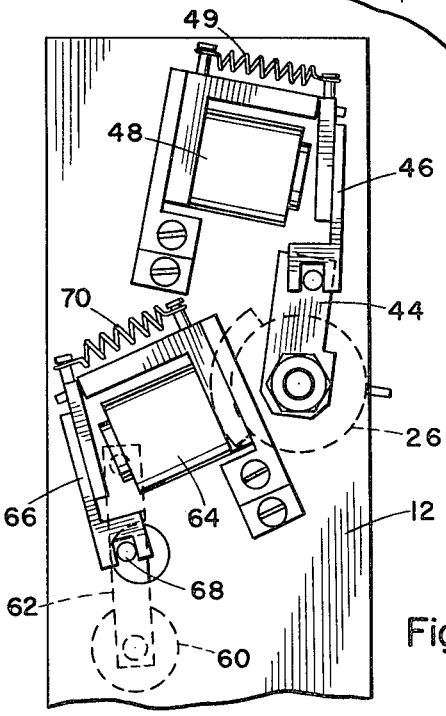
FIG. 4 is a side elevation view as taken from the right hand side of FIG. 3.

A pinch or escrow roller 60 is mounted on an arm 62 and extends through an opening in the opposed plate 50 for selective engagement with the transport roller 52 for drivingly engaging a ticket therebetween. This pinch or escrow roller 60 as it may be called, is selectively actuated to the engaged position by means of a clapper solenoid 64 connected by arm 66 and pin 68 as shown for example in FIGS. 3 and 4, for selective movement into and out of engagement with the drive or transport roller 52. The escrow roller 60 is biased to a non-engaging position (FIG. 5) by means of a tension spring 70 (FIG. 4).

Figure 7:
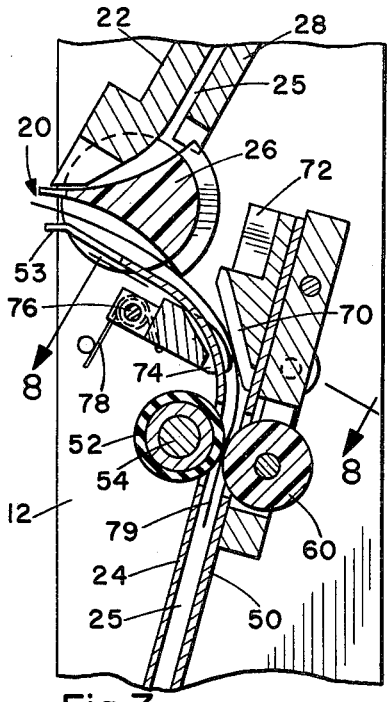
FIG. 7 is a sectional view similar to FIG. 5 but showing a thermal cancel device installed.

Turning to FIG. 7, the unit can include a heat cancelling unit in the form of a pair of spaced apart heating elements or pads 70 for engaging the edges of a ticket and including resistance heaters 72 for heating the pads 70. The heating pads 70 may preferably be mounted on a heat insulator (not shown) for insulating the heat from the remaining housing. A pair of fingers 74 are pivotally mounted on a shaft 76 and spring biased by a spring 78 into engagement with a ticket 79 for biasing the ticket into engagement with the thermal cancelling elements 70.

As best seen in FIGS. 1 and 3, the capture passage also includes ticket sensing means in the form of a light source such as a light emitting diode (LED 80) and a light sensing element 82 for sensing the light from the diode and any interruptions therein. Thus, a ticket passing between or situated between the LED 80 and the sensing element interrupts the light therebetween and such interruption is sensed by control means and a signal generated.

The diverter unit as above described can be constructed without escrow, that is, without the feature of holding a ticket in the capture passage for subsequent inspection, with the escrow feature, and also with the thermal cancel feature. Thus, the unit can have either one or both of these modifications.

In operation, the unit is disposed in interfacing cooperative relationship with a transport unit 16 as shown in FIG. 2 for receiving a ticket therefrom as shown in FIG. 5. The condition of the ticket is sensed or read and if the ticket is to be returned to the patron, no signal need be transmitted to the diverter unit. The ticket passes up the exit passage as shown in FIG. 5. If the ticket is to be retained, and a signal generated thereby is transmitted to and activates the control solenoid 48 of the diverter unit for shifting the diverter plate 26 as seen in FIGS. 6 and 7 for diverting the ticket to the capture passage.

Should the ticket be invalid or have insufficient fare, it will be diverted to the capture passage, either for depositing in the discard container or for holding in escrow for subsequent inspection. If the ticket is to be held in escrow, pinch roller 60 is left in the disengaged position (FIG. 5) and the ticket will hang up in the curve between plates 24 and 50 out of engagement with drive roller 52. Upon engagement of the ticket between rollers 52 and 60 it will be driven by the normally rotating roller 52 through the passage and out the lower end thereof.

A suitable signal can be generated for the existence of a ticket to be inspected. For example, should the ticket require inspection, a suitable signal will be given that a ticket is held within the capture passage for inspection. Such action can be indicated a suitable signal such as an audible alarm or a light. Upon removal of the ticket, the unit can be reactivated and immediately put back in service.

Should the ticket require cancelling, the thermal cancel elements 70 will be heated and the ticket passing therealong as in FIG. 7, will be biased into engagement with the thermal elements and the coding thereon suitably cancelled.

Thus, while I have illustrated and described my invention by means of specific embodiments, it is to be understood that numerous changes and modifications may be made therein without departing from the spirit and scope of the invention as defined in the appended claims.

I claim:

1. A diverter module unit for a ticket handling system, said unit comprising:

housing means defining a ticket inlet and a plurality of ticket outlets, one of said outlets is an exit outlet for returning a ticket to a patron, the other of said outlets is a capture passage for retaining a ticket, diverter means for selectively diverting a ticket from said inlet to a selected one of said outlets, said capture passage includes escrow means for selectively holding a ticket for inspection, said escrow means includes a transport roller for engaging a ticket in said capture passage, and an escrow roller for selective movement into and out of engagement with said transport roller.

2. The diverter unit of claim 1 wherein:

said inlet is adapted to receive a ticket from an adjacent transport unit, and said diverter means is responsive to a signal from said transport unit.

3. The diverter unit of claim 1 wherein said capture passage includes thermal cancelling means for selectively cancelling a ticket passing therethrough.

4. The diverter unit of claim 2 wherein said diverter means is a plate that is selectively rotatable between alternate diverting positions, and solenoid means operatively connected for moving said plate between said positions.

5. The diverter module of claim 1 comprising solenoid means operatively connected for selectively biasing said escrow rollers into engagement with said transport rollers.

6. A diverter module unit for a ticket handling system, said unit comprising:

housing means defining a ticket inlet and a plurality of ticket outlets, diverter means for selectively diverting a ticket from said inlet to a selected one of said outlets, one of said outlets is an exit outlet for returning a ticket to a patron, the other of said outlets is a capture passage for retaining a ticket, said capture passage includes thermal cancelling means for selectively cancelling a ticket passing therethrough, said thermal means comprises a pair of spaced apart strips for engaging the edges of a ticket, and finger means for biasing a ticket into engagement with said strips.

7. The diverter unit of claim 6 wherein said capture passage includes escrow means for selectively holding a ticket for inspection.

8. The diverter unit of claim 6 including:

escrow means in said capture passage for selectively holding a ticket for inspection.

9. The diverter unit of claim 8 wherein:

said diverter means is a plate that is selectively rotatable between alternate diverting positions, and solenoid means operatively connected for moving said plate between said positions.

* * * * *